US006014841A

United States Patent [19]

McCoy, Jr. et al.

[11] Patent Number: 6,014,841

[45] Date of Patent: Jan. 18, 2000

[54] INSULATED COVER FOR ATTIC OPENINGS

[76] Inventors: George W. McCoy, Jr., 7312 Maywood, Raytown; George W. McCoy, Sr., 733 Sundown, Independence, both of Mo.

[21] Appl. No.: 09/088,020

[22] Filed: Jun. 1, 1998

[51] Int. Cl.[7] ..... E06B 3/30; E06B 7/00; E04F 19/08

[52] U.S. Cl. ..... 52/19; 52/39; 52/202; 52/407.2; 182/46; 182/77; 49/463

[58] Field of Search ..... 52/39, 19, 186, 52/202, 407.2, 23, 405.1, 406.1, 794.1; 182/46, 47, 77–81; 312/100, 101; 49/463

[56] References Cited

U.S. PATENT DOCUMENTS

| | | | |
|---|---|---|---|
| 4,044,813 | 8/1977 | Emmons | 52/202 X |
| 4,202,389 | 5/1980 | Ewald | 312/101 X |
| 4,299,059 | 11/1981 | Smith | 182/47 X |
| 4,312,423 | 1/1982 | Helbig | 182/46 |
| 4,332,114 | 6/1982 | Goebel et al. | 182/47 X |
| 4,376,082 | 3/1983 | Heck | 312/100 |
| 4,563,845 | 1/1986 | Stipe | 52/202 |
| 4,567,074 | 1/1986 | Litaker | 182/46 X |
| 4,616,456 | 10/1986 | Parker | 52/202 |
| 4,788,805 | 12/1988 | Shaw | 52/202 |
| 4,928,441 | 5/1990 | Daley | 52/202 X |
| 5,125,197 | 6/1992 | Fuchs | 52/202 |
| 5,341,860 | 8/1994 | Klein | 52/202 X |

*Primary Examiner*—Laura A. Callo
*Attorney, Agent, or Firm*—Hovey, Williams, Timmons & Collins

[57] ABSTRACT

A cover apparatus (10) is provided which is easily and quickly installed, is simple to use, and is cost effective for selective closing of an attic opening (14) and for providing a thermal and dust barrier. The cover apparatus (10) preferably includes structure (12), adapted for placement over an opening (14) defined by peripheral wall or ceiling surfaces (16), and a plurality of snap fasteners (18*a*, 18*b*, 18*c*, 18*d*) for detachably coupling the structure (12) to the surfaces (16). The structure (12) includes a panel (20) presenting an inboard face (22), continuous, circumscribing sidewalls (24) extending from the inboard face (22) of panel (20), and a continuous, circumscribing flange (32) extending transversely and outwardly from the outer margin (28) of the sidewalls (24). The flange (32) includes an outermost lip (36) configured for firmly engaging the surfaces (16) when the structure (12) is coupled to the surfaces (16). Each snap fastener (18*a–d*) has an interconnecting first and second element (38, 40), with each first element (38) being adapted for attachment to the surfaces (16) adjacent the opening (14), and each corresponding second element (40) being secured to the flange (32). In addition, the apparatus (10) includes insulation (48) disposed within the enclosure (30) cooperatively defined by the panel (20) and the sidewalls (24) of the structure (12) in order to promote an air-tight seal and provide a thermal barrier when the structure (12) is coupled to the surfaces (16).

2 Claims, 2 Drawing Sheets

INSULATED COVER FOR ATTIC OPENINGS

BACKGROUND OF THE INVENTION

1. Field of the Invention

The present invention relates to a cover apparatus adapted for positioning over a room opening for selective closing thereof, most especially an attic opening. More particularly, the invention pertains to such a cover apparatus which includes structure having a panel, continuous sidewalls circumscribing the inboard face of the panel, and a flange extending transversely and outwardly from the outer margin of the sidewalls. The flange presents an outermost lip for engaging the peripheral surfaces of the wall or ceiling of the room which defines the opening. The preferred apparatus also includes a plurality of snap fasteners which detachably couple the structure to the surfaces. Insulation is disposed within the enclosure defined by the panel and the sidewalls to promote an air-tight seal and provide a thermal barrier when the structure is detachably coupled to the surfaces.

2. Description of the Prior Art

Openings in attics are common in most houses. Such openings serve as the ventilation inlet for an attic fan, or are simply used to provide access into the attic for storage purposes. Since attics are typically filled with dust particles and are a source of extreme temperature, attic openings covers have been developed to act as a dust and thermal barrier.

Attic opening covers of varying complexity are known in the art. For example, an electric shutter system can be installed for use with an attic fan to automatically open and close the shutters when an attic fan is correspondingly switched on and off. A less sophisticated cover consists of a wood panel designed for resting on top of an opening in the center of a room.

The devices of the prior art, however, have several notable drawbacks. The electric shutter system designed for use with an attic fan can be very expensive and difficult to install. An electrical feed is required, and the shutters in the closed position do not usually establish an air-tight seal. Accordingly, heat from the room often escapes through the shutters during the cold winter months, and heat from the attic will seep through the shutters into the house during hot summer months. In addition, dust and insulation particles can escape through the shutters and into the room.

The wood panel cover provides a similarly deficient thermal and dust barrier. Insulation could be added to the panel in order to restrict air movement through the opening and provide a thermal barrier. However, such installation typically interferes with the removal of the cover when a user is accessing the attic. Further, if insulation is dislodged during cover removal, particles of insulation could be released into the room.

SUMMARY OF THE INVENTION

The problems outlined above are in large measure solved by the cover apparatus in accordance with the present invention. That is to say, the cover apparatus hereof is specially designed to be easily and quickly installed adjacent an attic opening, is simple to use, and is a cost-effective means for selectively closing an opening and providing a thermal and dust barrier between the opening and the room.

The cover apparatus of the present invention broadly includes structure adapted for placement over an attic opening defined by peripheral wall or ceiling surfaces for selective closing of the opening, and a plurality of snap fasteners for detachably coupling the structure to the surfaces. The structure includes a panel presenting an inboard face, continuous sidewalls extending from the inboard face and circumscribing the panel, and a continuous, circumscribing flange extending transversely and outwardly from the outer margin of the sidewalls. The flange presents an outermost lip configured for engaging the surfaces when the structure is coupled to the surfaces. Each snap fastener has interconnecting first and second elements. Each first element is adapted for attachment to the surfaces adjacent the opening, and each corresponding second element is secured to the flange.

In preferred forms, the cover apparatus includes insulation disposed within the enclosure defined by the panel and the sidewalls. The insulation engages the panel, the inner margin of the sidewalls and the surfaces adjacent the opening in order to promote an air-tight seal and provide a thermal barrier when the structure is coupled to the surfaces. The flange is preferably formed of resilient material in order to allow deformation thereof when the structure is coupled with the surfaces. Such flange deformation creates a biasing force which urges the lip into firm engagement with the surfaces.

DETAILED DESCRIPTION OF THE PREFERRED EMBODIMENT

Figure 1:
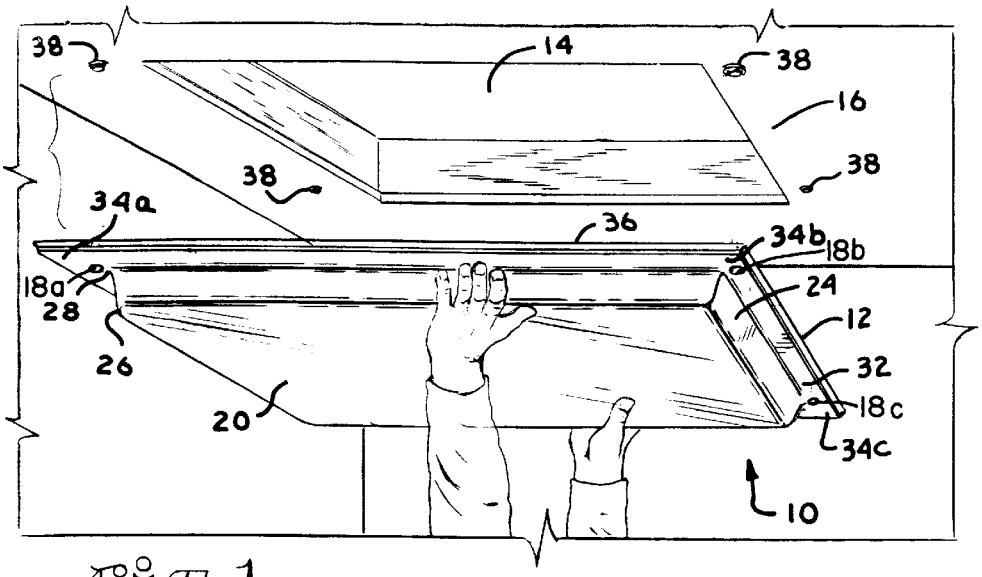
FIG. 1 is a perspective view of the preferred cover apparatus in accordance with the present invention, shown during installation thereof over a ceiling attic opening.
Figure 2:
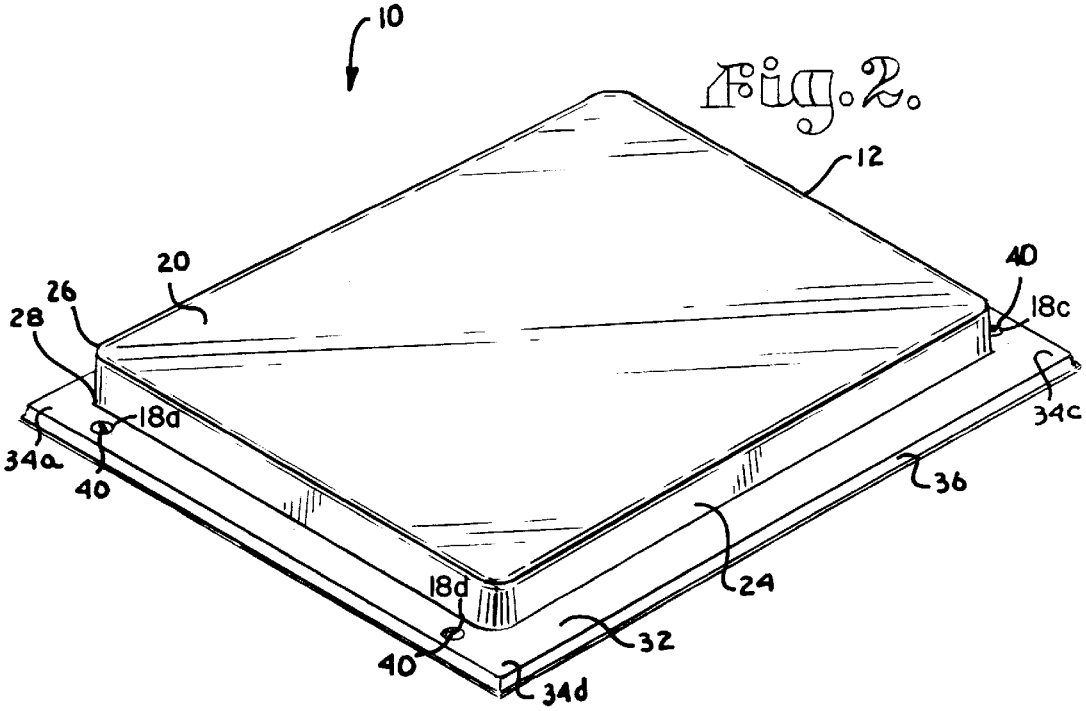
FIG. 2 is a perspective view of the cover apparatus.

Turning now to the drawings, FIGS. 1 and 2 illustrate a preferred cover apparatus 10 in accordance with the invention. Broadly, apparatus 10 includes a rectangular cover structure 12 adapted for selective placement in a covering relationship with an attic opening 14 such as that defined by peripheral ceiling surfaces 16. The apparatus 10 has four snap fasteners 18*a*, 18*b*, 18*c*, 18*d* for detachably coupling structure 12 to surfaces 16. Structure 12 is of integral construction and is preferably fabricated from any suitable synthetic resin material such as high impact polystyrene plastic.

In more detail, structure 12 includes a rectangular panel 20 presenting an inboard face 22, and continuous, circumscribing, somewhat oblique sidewalls 24 extending from inboard face 22. Each sidewall 24 presents an inner margin 26 adjacent inboard face 22 and an opposed outer margin 28. Panel 20 and sidewalls 24 of structure 12 cooperatively define an enclosure 30, the purpose of which will be discussed hereinbelow. A continuous, circumscribing flange 32 extends transversely and outwardly from outer margin 28 of sidewall 24. Flange 32 presents four opposing corners 34*a*, 34*b*, 34*c*, 34*d*, and includes an outermost, continuous, circumscribing, generally L-shaped lip 36 configured for engaging surfaces 16 when structure 12 is detachably coupled thereto.

Figure 3:
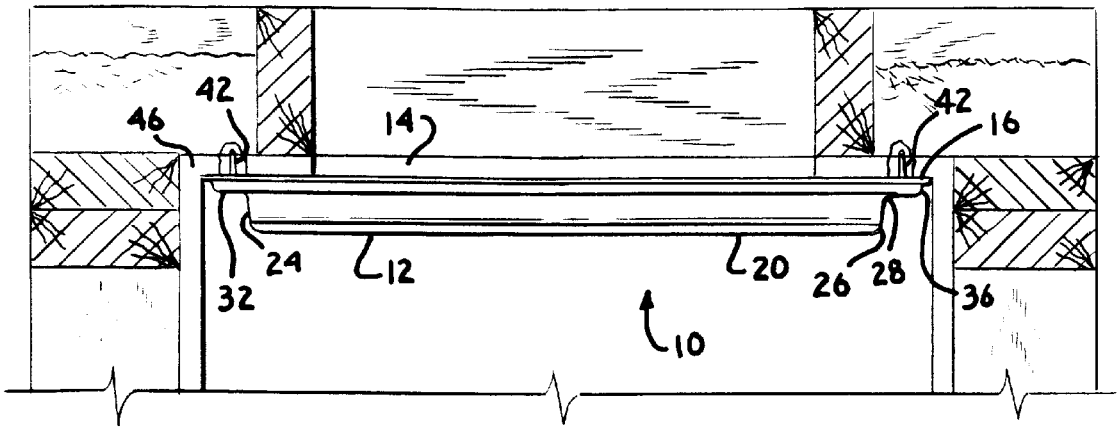
FIG. 3 is a fragmentary, partially sectional view of the cover apparatus of the invention, showing the cover detachably coupled to the peripheral surfaces of the ceiling opening, with portions of the ceiling broken away to reveal the anchors for receiving the screws for securing the snap fasteners.
Figure 4:
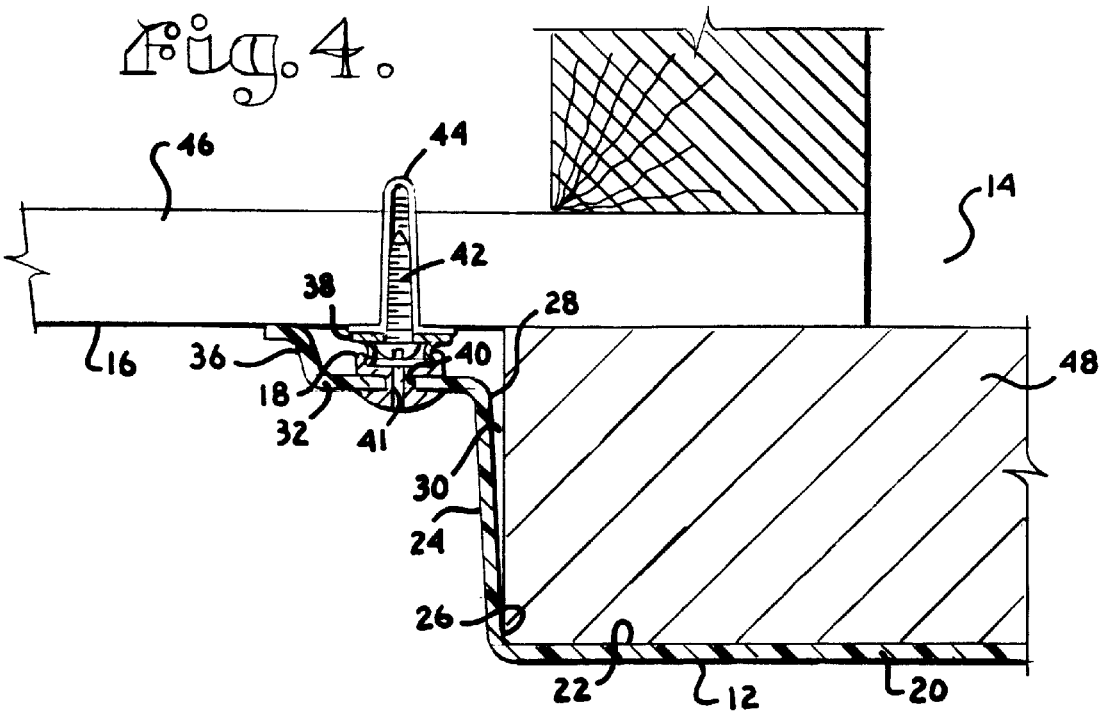
FIG. 4 is a fragmentary, vertical sectional view illustrating the snap fasteners detachably coupling the structure to the surface, and further showing the insulation disposed within the structure and engaging the surface to promote an air-tight seal and provide a thermal barrier.

Snap fasteners 18*a–d* are used to detachably couple structure 12 to surfaces 16, as shown in FIGS. 3 and 4. Each fastener 18*a–d* includes interconnecting first and second elements 38, 40. Each second element 40 is secured to flange 32 adjacent a corresponding flange corner 34*a–d* and each second element 40 preferably has a centrally located aperture 41 therethrough. Each first element 38 is attached to surfaces 16 adjacent opening 14 using a screw 42. Proper placement is required when securing each first element 38 of the four fasteners 18*a–d* to the surfaces 16, so that each first element 38 will correspondingly interconnect with each respective second element 40 to provide for proper detachable coupling of structure 12 to surfaces 16. If screw 42 cannot be driven into a wood member such as a frame to the opening 14 or a ceiling joist (not shown), then a drywall anchor 44 must first be installed into the ceiling drywall material 46 for threadable receipt of screw 42, as depicted in FIG. 4.

In preferred forms, apparatus 10 includes polystyrene foam insulation 48 or other suitable insulation material disposed within enclosure 30 and secured to inboard face 22 of panel 20 using an appropriate adhesive. Insulation 48 engages panel 20, inner margin 26 of sidewalls 24, and surfaces 16 adjacent opening 14 when structure 12 is coupled to surfaces 16 (see FIG. 4).

In operation, apparatus 10 is positioned over opening 14 for closing thereof by alignment of respective first and second elements 38, 40 of each of the four fasteners 18*a–d*, as shown in FIG. 1. The apparatus 10 is pressed upward until lip 36 engages surfaces 16, and then a user individually applies pressure to each second element 40 of the four fasteners 18*a–d* in order to cause interconnection thereof with each respective first element 38 to thereby couple structure 12 to surfaces 16. Once lip 36 engages surface 16 and first and second elements 38, 40 are interconnected, flange 32 is slightly deformed and concave in cross-section. Such deformation of flange 32 creates a biasing force exerted upwardly against lip 36 to establish and maintain a firm engagement between lip 36 and surfaces 16.

When structure 12 is detachably coupled to surfaces 16, insulation 48 disposed within enclosure 30 engages surfaces 16 adjacent opening 14 and becomes slightly compressed. By engaging surfaces 16, panel 20 and inner margin 26 of sidewalls 24, insulation 48 will thus promote an air-tight seal and establish a thermal barrier between opening 14 and the room.

If access to opening 14 is desired, a user simply grasps sidewalls 24 by applying inward pressure thereto and then applies downward pressure until each second element 40 of the four fasteners 18*a–d* is disconnected from each corresponding first element 38. It will be appreciated that because insulation 48 is permanently secured to inboard face 22 of panel 20 and contained within enclosure 30, detachment of structure 12 from surfaces 16 to uncover opening 14 will not be impeded by insulation 48 and will not result in the dispersal of insulation particles throughout the room.

Those skilled in the art will appreciate that the teachings of the cover apparatus 10 hereof may include a variety of embodiments in addition to the preferred embodiment hereinabove described. For example, structure 12 may be configured for horizontal or vertical placement over openings of various shapes and sizes, such as a circular opening in a wall adjacent an attic fan. In such event, the size, shape and arrangement of components may require appropriate modification.

We claim:

1. Cover apparatus adapted for positioning adjacent an attic opening for selective closing thereof, said opening defined by peripheral ceiling or wall surfaces, said apparatus comprising:

structure adapted for selective placement in covering relationship to said opening and including panel presenting an inboard face, continuous, circumscribing sidewalls extending from said inboard face and each presenting an inner margin adjacent said inboard face and an opposed outer margin, said panel and said sidewalls cooperatively defining an enclosure, and a continuous, circumscribing flange extending transversely and outwardly from said outer margin, said flange presenting an outermost lip extending therefrom and configured for engaging said surfaces when said structure is detachably coupled to said surfaces, said flange being formed of resilient material capable of deformation of the flange when the structure is detachably coupled with said surfaces;

insulation received within said enclosure and engaging the entire inboard face of the panel and said sidewalls and extending beyond said outer margin whereby to present a face which is substantially coplanar with that of the lip; and means for detachably coupling said structure to said surfaces including a plurality of snap fasteners, said snap fasteners each having interconnecting first and second elements, each of said first elements being adapted for attachment to said surfaces proximal to said opening, each of said second elements being secured to said flange inwardly of said lip and configured for interconnection with a corresponding one of said first elements to thereby detachably couple said structure to said surfaces, said lip being deformed when said structure is so coupled, the face of the insulation adapted to engage the proximal surface of the adjacent ceiling or wall surfaces.

2. The apparatus of claim 1 wherein each of said second elements has a body presenting a centrally located aperture therethrough.

* * * * *